US005755162A

United States Patent [19]

Knight et al.

[11] Patent Number: 5,755,162

[45] Date of Patent: May 26, 1998

[54] REINFORCED PLASTIC PALLET

[75] Inventors: John W. Knight, New Concord; Paul W. Baker, Cambridge; David Paul Jones, Kimbolton, all of Ohio

[73] Assignee: The Fabri-Form Co., Byesville, Ohio

[21] Appl. No.: 399,747

[22] Filed: Mar. 7, 1995

Related U.S. Application Data

[63] Continuation-in-part of Ser. No. 258,433, Jun. 10, 1994.

[51] Int. Cl.[6] ..... B65D 19/00

[52] U.S. Cl. ..... 108/51.1; 108/901

[58] Field of Search ..... 108/51.1, 901, 108/902

[56] References Cited

U.S. PATENT DOCUMENTS

| | | | |
|---|---|---|---|
| 1,770,614 | 7/1930 | Hennessy | 108/901 X |
| 3,795,206 | 3/1974 | Utz | 108/901 X |
| 3,880,092 | 4/1975 | Seeber et al. | 108/901 X |
| 4,246,734 | 1/1981 | Fogle, Jr. et al. | 108/901 X |
| 4,392,247 | 7/1983 | Lemelson | 108/901 X |
| 4,879,956 | 11/1989 | Shuert | 108/901 X |
| 5,401,347 | 3/1995 | Shuert | 108/901 X |
| 5,404,829 | 4/1995 | Shuert | 108/901 X |
| 5,408,937 | 4/1995 | Knight, IV et al. | 108/901 X |

FOREIGN PATENT DOCUMENTS

| | | | |
|---|---|---|---|
| 2612153 | 9/1988 | France | 108/901 |
| 2165676 | 7/1973 | Germany . | |
| 2535681 | 2/1977 | Germany . | |
| 2655593 | 6/1977 | Germany | 108/901 |
| 2651929 | 5/1978 | Germany . | |
| 2909541 | 9/1980 | Germany . | |

OTHER PUBLICATIONS

P. 870 from Jul. 21, 1981, Official Gazette showing abstract of U.S. Pat. No. 4,279, 204.

Advertisement fro PRO–FORM Germantown, WI (2 pages).

Advertisement from Global Equipment Co.

Front cover of Aug. 31, 1992, Chemical & Engineering News.

Advertisement from Litco International, Inc., Vienna, Ohio Showing Inca Pallet (4 pages).

Advertisemnet from Tuscarora Container System, Beaver, Pa.

Advertisement from US Corrilite Corps., Clewiston, Fla.

*Primary Examiner*—Jose V. Chen

*Attorney, Agent, or Firm*—Renner, Kenner, Greive, Bobak, Taylor & Weber

[57] ABSTRACT

A reinforced pallet (10) includes an upper surface (11) and a pair of opposing support sides (14, 15). The pallet (10) also includes at least one reinforcing bar channel (50) and a reinforcing bar (40) received within reinforcing bar channel (50). A twin-sheet pallet (10) is formed vacuum-forming a first plastic sheet (33*a*) to a first mold section (30) and a second plastic sheet (33*b*) to a second mold sheet (31), wherein a preselected portion of the second mold section (31) is sealed such that the second plastic sheet (33*b*) is not vacuum-formed. The mold sections (30, 31) are then moved together and the sheets (33*a*, 33*b*) are compressed together at preselected locations. A thermoformed, plastic pallet (10) for bearing and positioning a load, also includes and a retaining wall assembly (90) carried by the upper surface (11); the retaining wall assembly (90) including a wall-receiving slot (91) in the upper surface (11) and a retaining wall means (92) received and positioned within the slot (91). The pallet (130) has a plurality of angled, spaced reinforcing bars (40*a* and 40*b*) supported by a plurality of cooperating webs 150.

12 Claims, 13 Drawing Sheets

REINFORCED PLASTIC PALLET

RELATED CASES

This application is a continuation-in-part of co-pending U.S. patent application Ser. No. 08/258,433 filed on Jun. 10, 1994.

TECHNICAL FIELD

This invention relates to a plastic pallet. More particularly, the invention relates to a thermoformed, plastic pallet. Specifically, the invention relates to a thermoformed, plastic pallet which is strengthened by a reinforcing bar received in a channel therein, and which is provided with strengthened support feet. One embodiment of the present invention has a plurality of reinforcing bars at least two of which are positioned at an angle with respect to each other.

BACKGROUND OF THE INVENTION

Pallets are load bearing structures used to provide a stable platform for the storage, transportation or shipment of materials. The materials are often strapped or bound and then placed and/or stacked onto the pallet.

It is known to provide pallets with feet or other structures to raise the pallet off a support surface such as the ground, in order to allow a forklift blade to move under the pallet and to lift the entire load. While pallets are often made of wood, it is desirable to thermoform plastic pallets. Such plastic pallets are often stronger, less expensive, and less susceptible to degradation caused by weathering or the like than their wooden counterparts. Structures such as the feet, strengthening grooves and other components, may be formed in the pallets during the thermoforming operation. It is known to form "twin sheet" pallets, such that two sheets are softened and thermoformed together to make the finished pallet.

One method of forming pallets, including twin sheet pallets, has been to provide a first and second mold sections. A separate plastic blank sheet is then formed to each mold section, such as by vacuum-forming, and the two mold sections are then brought together under pressure until the plastic blank sheets, still at elevated temperatures from the vacuum-forming process, are in contact. The sections of the plastic blank sheets that are in contact are pressed together such that they actually fuse into a solid portion.

It has been known to further strengthen plastic pallets by the use of a reinforcing substructure or framework. Such substructures are often made of metal or wood. For example, a metal framework may be employed such that the pallet is thermoformed around the framework, such as by having the framework "sandwiched" between the two sheets of a twin sheet pallet.

Pallets having a metal or even wooden reinforced substructure are generally stronger than their non-reinforced counterparts. However, the substructures often dramatically increase the weight of the pallet. In storage and shipping operations, weight is usually a primary concern, and a pallet having an increased weight would likely be detrimental to the pallet's overall desirability.

Further, heretofore, while reinforced pallets have been known, such do not provide for improved resistance to torsional stresses at the outer edges of the pallets. Pallets are often stacked one on top of another for storage and transportation. The pallets are often stacked upon their outer edges. It is also sometimes the case that loaded pallets, that is, pallets bearing a load thereon, will be lifted by the edges of the pallet. Known reinforced pallets will not successfully compensate for induced edge stresses, which often result in torsional forces being applied to the pallet edges.

A need exists, therefore, for a reinforced pallet which does not dramatically differ in weight compared to an unreinforced counterpart, and which is successfully reinforced against induced torsional edge forces.

It is also desired that load bearing pallets be provided with retaining elements to support the load of material placed thereon, and thus help to prevent movement and shifting of the material on the pallet during transport and the like. For example, it is known to wrap material on pallets in plastic shrink wrap, or to band the material with metal or plastic straps. The materials are also often placed in boxes which can be stacked and secured in this manner. It is desirable to have a securing mechanism that will cooperate with the pallet itself to provide securing to the pallet. Thus, strapping is often wrapped around the materials and/or their storage boxes that are stacked on the pallet, and then around the pallet itself. Pallets are sometimes configured with slots to act as guide channels for the strapping material. While strapping has proven to be an effective means of securing stacked materials, shifting of the materials still occurs with known pallets.

A need exists therefore, for a pallet provided with a structure to minimize shifting of the materials stacked on the pallet during shipment and storage.

SUMMARY OF INVENTION

It is, therefore, an object of the present invention to provide a plastic pallet.

It is another object of the present invention to provide a reinforced plastic pallet.

It is yet another object of the present invention to provide a method of forming a reinforced plastic pallet.

It is a further object of the invention to provide a pallet with a retaining wall to help prevent movement of materials stacked on the pallet.

At least one or more of the foregoing objects, together with the advantages thereof over the known art relating to plastic pallets, which shall become apparent from the specification which follows, are accomplished by the invention as hereinafter described and claimed.

In general, the present invention provides a reinforced, thermoformed, plastic pallet for bearing a load, which includes a generally rectilinear body having an upper surface, a lower surface, and at least one pair of opposing sides. The pallet also includes at least one reinforcing bar-receiving channel extending substantially longitudinally between the at least one pair of opposing sides. Reinforcing bar means are received within the at least one reinforcing bar-receiving channel.

The present invention also includes a method for forming a reinforced plastic pallet including the steps of thermoforming a first and a second plastic blank into the shape of the desired pallet; the step of thermoforming including the steps of fusing selected portions of the first and second blanks together, and forming of selected open areas between the fused portions. At least one of the open areas is formed in the shape of a channel. The method also includes positioning a reinforcing bar within the channel.

There is also provided a method for vacuum-forming a twin sheet plastic pallet using a first mold section and a second mold section, and a separate plastic blank sheet formed on each of the mold sections. The method includes the steps of sealing a preselected portion of at least the first mold section, such that when one of the plastic blank sheets is vacuum-formed to the first mold section, the plastic blank sheet is not vacuum-formed in the preselected sealed portion. The method also includes individually vacuum-forming the plastic blank sheets to the first and second mold sections, and moving the first and second mold sections together, such that the plastic blank sheets are compressed together in at least the preselected sealed portion.

According to one embodiment of the present invention, a twin-sheet plastic pallet for bearing a load comprises a generally rectilinear, thermoformed body comprising a first sheet and a second sheet positioned in an opposing relation. Each first and second sheets carries first and second complementary socket portions respectively, such that the socket portions together form a first socket. A reinforcing bar is positioned within the first socket.

A method according to the invention of forming a reinforced plastic pallet also comprises the steps of thermoforming a first and a second plastic blank into the shape of the desired pallet, including forming a separate extending web in each of the first and second sheets. Each web has a complementary socket portion. The method also includes affixing the first and second sheets together in an opposing relation, such that the first and second complementary socket portions together form a first socket. A reinforcing bar is positioned within the first socket.

PREFERRED EMBODIMENT FOR CARRYING OUT THE INVENTION

Figure 1:
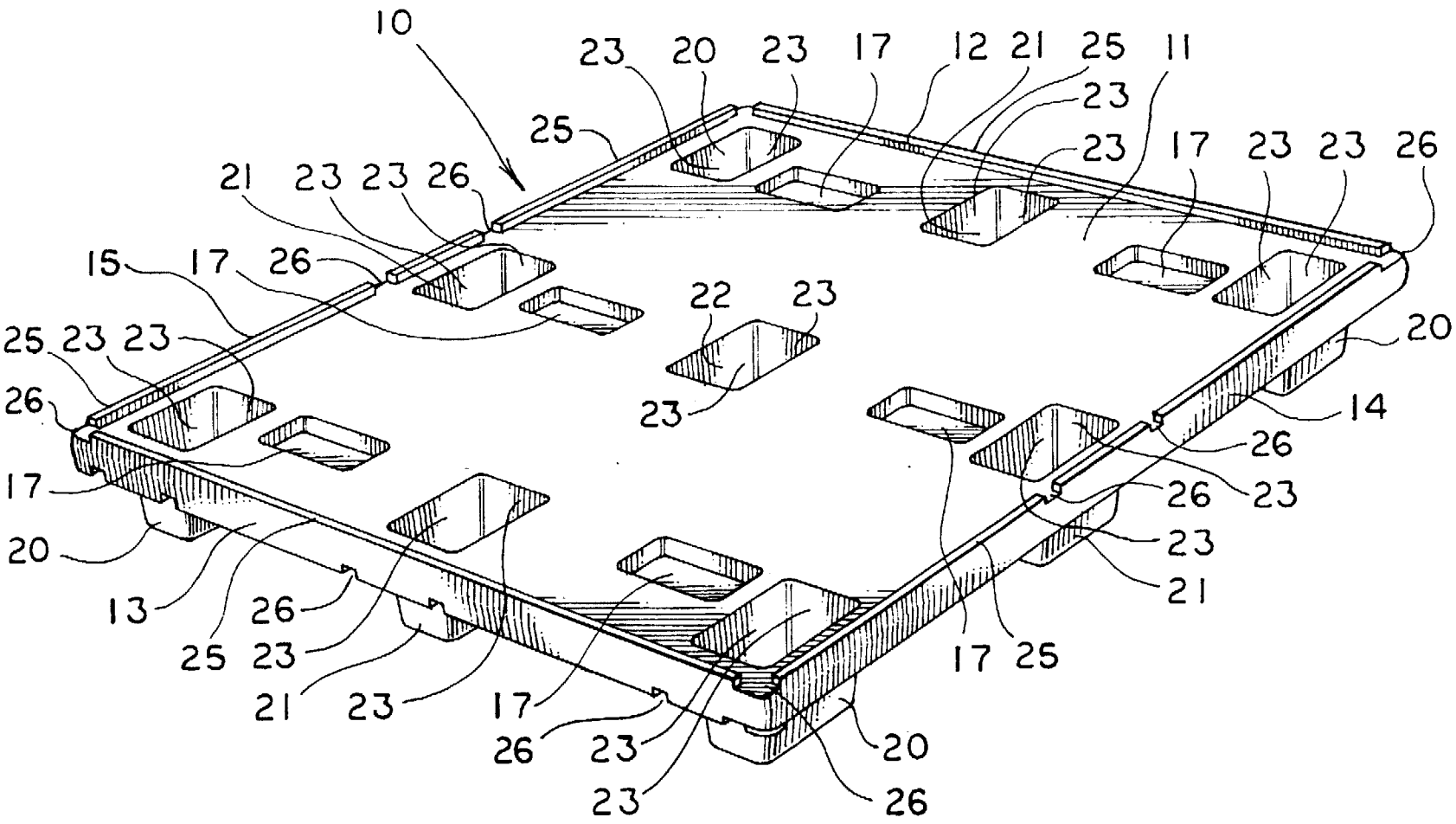
FIG. 1 is a perspective view of a pallet embodying the concepts of the present invention.

A pallet useful for bearing a load according to the present invention is generally designated by the number 10 on the attached drawings. Pallet 10 is the type useful for bearing a load, and may be provided with a generally planar, upper, load bearing surface 11. Pallet 10 is generally rectilinear, that is, pallet 10 is provided with spaced, opposing sides 12 and 13, as well as spaced opposing sides 14 and 15. Sides 12 and 13 are generally perpendicular to sides 14 and 15, and planar load bearing surface 11 generally extends between and connects sides 12, 13, 14 and 15. If desired, pallet 10 may be provided with apertures 17 for purposes of ventilation, weight saving, strength, or the like.

Pallet 10 is preferably provided with downwardly extending corner feet 20 which are used to raise pallet 10 from a support surface (not shown) such as the ground. Although the number of feet provided are not critical to the invention, it is preferred to provide pallet 10 with at least feet 20 in the corners of the pallet, and with feet 21 between each of the corner feet 20, as well as with a center foot 22. Each foot 20, 21, 22 preferably is provided with downwardly extending sidewalls 23 terminating in a foot floor 24 which extends between and interconnects downwardly extending sidewalls 23.

Pallet 10 may also be provided with edge protrusions or lips 25 which are used for strengthening pallet 10 and for aiding in the positioning of materials (not shown) upon pallet 10. Although not depicted in the drawings, lips or ribs similar to protrusions 25 may be positioned elsewhere on pallet 10 in order to further strengthen the pallet. Notches 26 may be provided in lips 25 and in side walls 12 and 13 to aid in tying down the materials on pallet 10, as well as for drainage and the like.

Although not necessarily an absolute limitation of the invention, it is preferred that pallet 10 is of a twin sheet, thermoformed construction. As is conventional in the art, it is known to vacuum, thermoform twin sheet pallets by employing a mold having a male section 30 (FIG. 8) and a female section 31. Separate plastic blank sheets 33 are heated and formed onto the male and female mold sections 30 and 31. As depicted in the drawings, the blank sheet to be formed on male mold 30 is numbered as blank sheet **33*a*, and the blank sheet to be formed on female mold 31 is numbered as blank sheet 33*b*. After pallet 10 is completed, blank sheet 33*a* is in a position on the top or upper side of pallet 10, while blank sheet 33*b* is positioned on the bottom or underneath side of pallet 10**.

A vacuum is pulled between the blank sheets **33*a* and 33*b* and the respective mold sections 30 and 31 in a conventional manner. It is often the case that a plurality of vacuum holes 34 are provided in each mold section, such that a vacuum can be pulled therethrough. The blank sheets 33 are thus pulled onto the mold sections 30 and 31, and conform to the shape thereof. The mold sections 30 and 31 can then be brought together (FIG. 9) such that the separate blank sheets are brought into physical contact. Depending upon the design of the mold sections, portions of the separate blank sheets 33** can be brought into contact while other portions do not contact. Under pressure, the contacting portions will weld or fuse together, forming an integral portion therebetween.

For example, each foot 20, 21 and 22 is preferably solid, such that there is substantially no open area between upper and lower sheets 33*a* and 33*b*. This "solid foot construction" adds to the overall strength of the pallet. The thermoforming process of an integral solid foot 20, 21 and 22 will be further addressed hereinbelow.

A preferred plastic material for formation of blank sheets 33 is high density polyethylene. The vacuum thermoforming processes for such a material will include heating the mold sections 30 and 31 to from about 180–280 degrees fahrenheit, while the plastic blank sheets 33 are generally heated to about 280 degrees fahrenheit. Other inventive characteristics of the methods according to the present invention will be further discussed hereinbelow.

The pallet 10 according to the invention is reinforced; that is, structure is provided which imparts greater strength to the pallet than the pallet would otherwise have. According to the present invention, at least one, and preferably a plurality of reinforcing bars 40 are used to reinforce pallet 10. Each reinforcing bar 40 is preferably of a "thin steel construction". That is, each reinforcing bar 40 has two opposing edges 41 and 42, which are generally parallel and spaced from the other by parallel opposing sides 43 and 44. The width dimension of edges 41 and 42 is preferably less than the width dimension of opposing sides 43 and 44, and hence, reinforcing bar 40 is of a thin steel construction. One example of a thin steel construction would be one wherein the width dimension ratio of edges 43 and 44 to that of 41 and 42 would be above 1:1 and up to about 4:1 or higher. While it is preferred to make reinforcing bar 40 from steel, other materials such as other metals, plastic, wood or the like are also within the scope of the invention.

Figure 3:
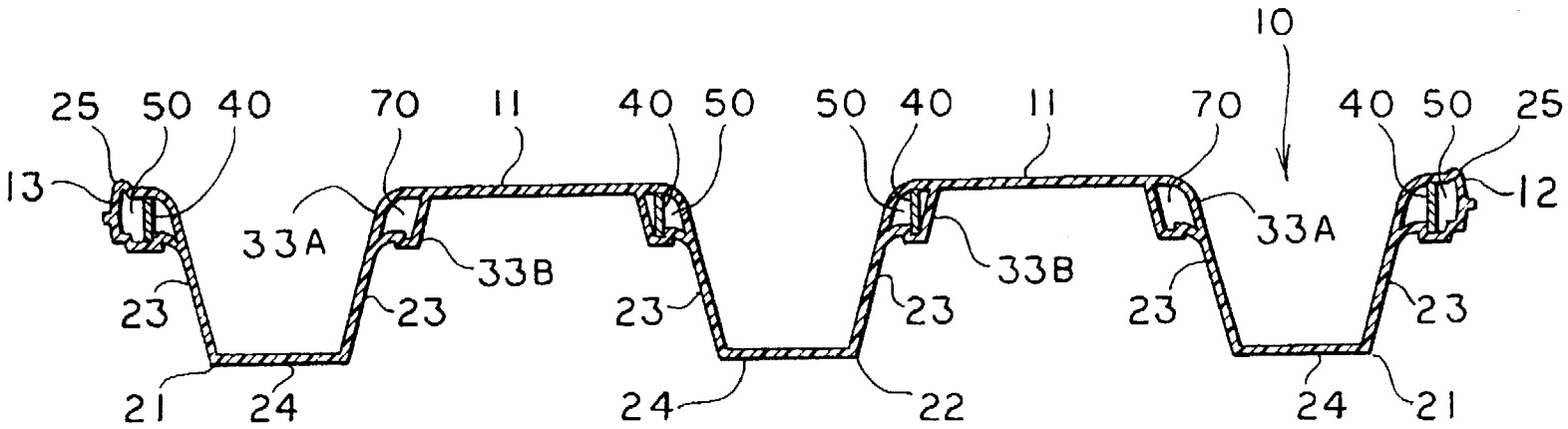
FIG. 3 is a sectional view taken substantially along line 3—3 of FIG. 2.
Figure 4:
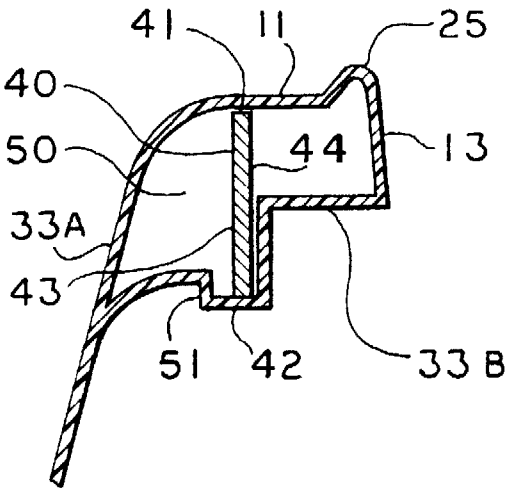
FIG. 4 is an enlarged view of one portion of FIG. 3.

Preferably, each reinforcing bar 40 is positioned within a reinforcing bar-receiving channel 50 within pallet 10. Channel 50 need be of no particular configuration. However, it is preferred that channel 50 be formed between portions of the two plastic blank sheets 33*a* and 33*b*, by forming areas therebetween which do not become fused together during the thermoforming process. Further, as shown in FIG. 3, a lip or ridge 51 may be provided in one or both of the blank sheets 33, such that reinforcing rod 40 is held in place by ridge 51, as shown with respect to lower blank sheet 33*b*.

Figure 6:
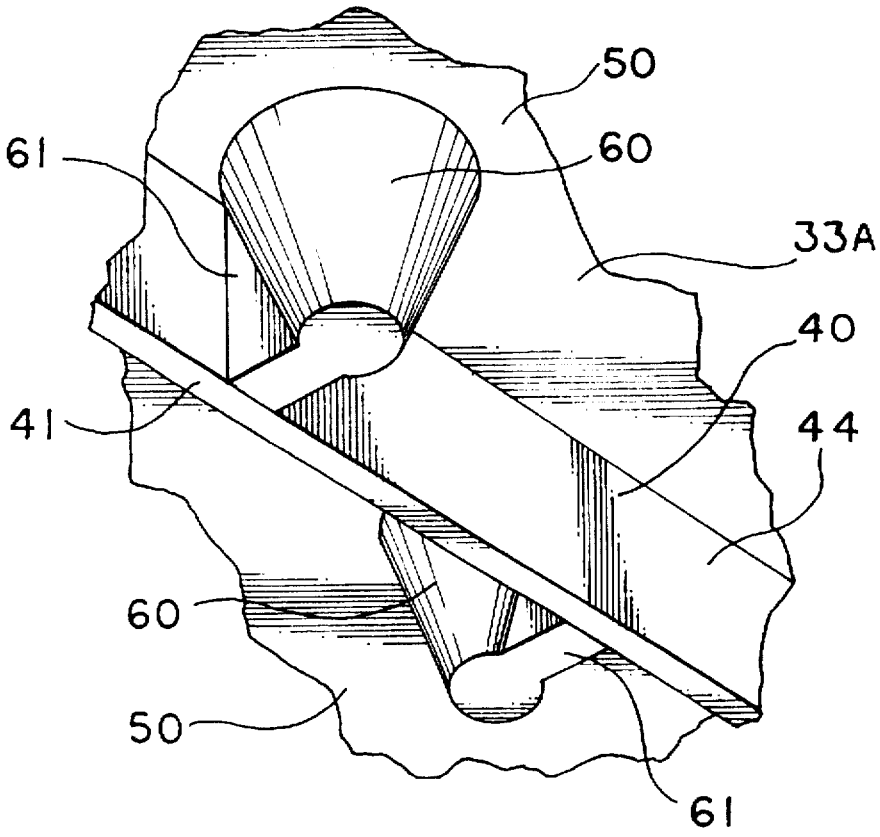
FIG. 6 is a fragmented, broken-away view of the pallet of FIG. 1, showing the details of the interior thereof.

Other means of forming channel 50 and for holding reinforcing bar 40 in place therein are within the scope of the invention. For example, channel 50 may be of a U-shaped, friction-fit construction (not shown). Also, pallet 10 may be provided with strengthening protrusions such as reinforcing cones 60. Cones 60 may be frusto-conical as depicted in FIG. 6. Cones 60 are preferably formed in a conventional thermoforming manner, and are used to provide strength between sheets 33*a* and 33*b*, and hence to pallet 10. Cones 60, or a preselected number thereof, may be thermoformed with positioning detents 61 which extend into channel 50 to a position proximate to reinforcing bar 40. Reinforcing bar 40 is restrained and positioned within channel 50 by physical contact with positioning detents 61. Other similar strengthening protrusions (not shown) may be provided throughout pallet 10, such as strengthening ribs, grooves and the like, with or without integral detents 61.

Reinforcing bars 40 are positioned within channels 50, such that they are "on-edge". That is, when positioned within channel 50, opposing sides 43 and 44 of reinforcing bar 40 are generally perpendicular to planar, load bearing surface 11 of pallet 10. Similarly, opposing edges 41 and 42 of reinforcing bar 40 are generally parallel to planar, load bearing surface 11. By being on-edge when positioned within channel 50, the strength of the pallet is increased. A load placed upon load bearing surface 11 will cause a force to be directed downward against the edge 41, which will be resisted by reinforcing bar 40, thus compensating for induced torsional forces upon pallet 10. The use of reinforcing bars 40 allows pallet 10 to be supported by a forklift, or other device, which can engage opposing support sides 14 and 15.

Figure 2:
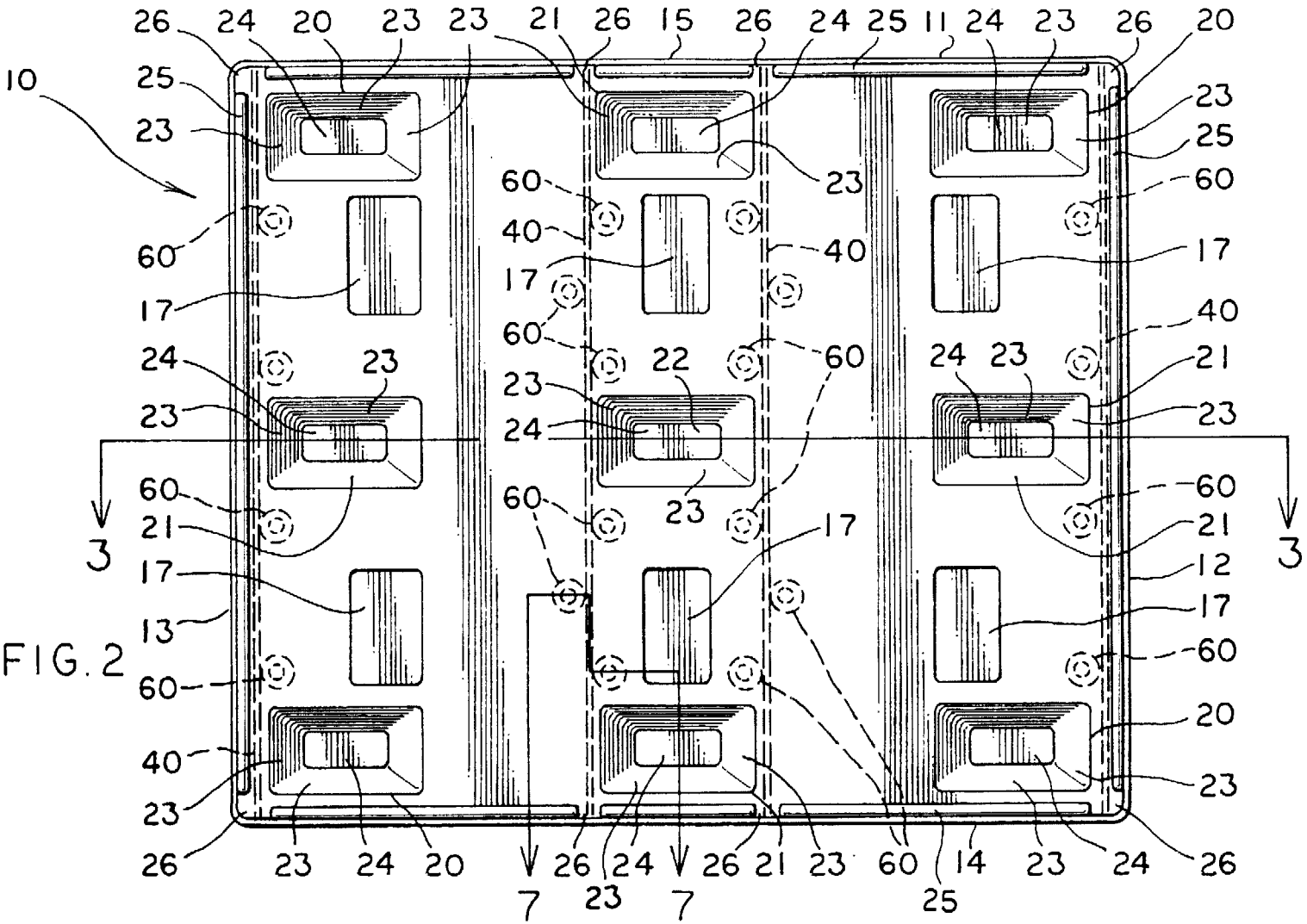
FIG. 2 is a top plan view of the pallet of FIG. 1.

As stated above, the number of reinforcing bars 40 positioned within pallet 10 is not critical to the invention. It is preferred however that a plurality of bars be positioned such that they are in a spaced parallel relation with each other. Each channel 50 is, therefore, also preferably provided in a spaced parallel manner, longitudinally extending between two sides, such as sides 14 and 15 of pallet 10. It is further preferred to position a reinforcing bar 40/channel 50 proximate to each of the edges 12 and 13 of pallet 10. In addition, it is preferred that two additional reinforcing bars 40/channels 50 may be positioned intermediate between those of and parallel to edges 12 and 13, as depicted in FIG. 2, thus providing interior reinforcing bars 40/channels 50.

Figure 5:
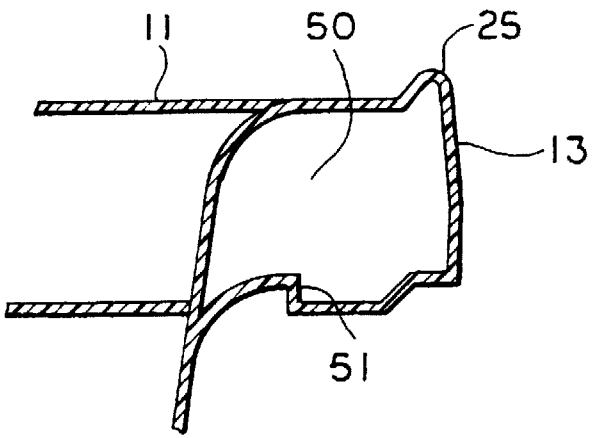
FIG. 5 is an enlarged view of another portion of FIG. 3.
Figure 7:
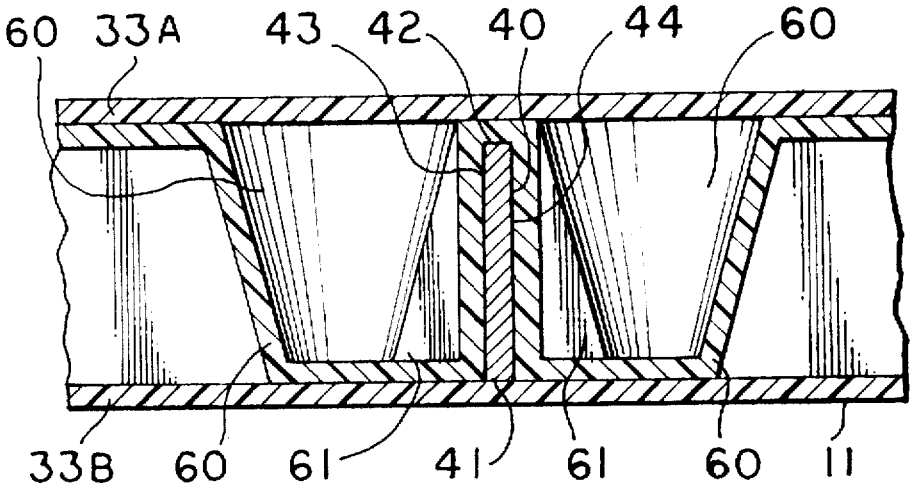
FIG. 7 is an enlarged, sectional view taken substantially along line 7—7 in FIG. 3.

As shown in FIG. 3, a number of additional intermediate channels 70 may be formed within pallet 10 during its thermoforming, such that reinforcing bars 40 may be positioned therein should the end user find the need for additional support. Similarly, for added weight savings, reinforcing bars 40 can be removed from channels 70 or even 50 should it be desirable as shown in FIG. 5. Any means for gaining access to channels 50 and 70 is within the scope of the invention. Thus, reinforcing bar 40 may be positioned within pallet 10 prior to moving mold sections 30 and/or 31, or it may be removably positioned therein subsequent to molding.

Figure 8:
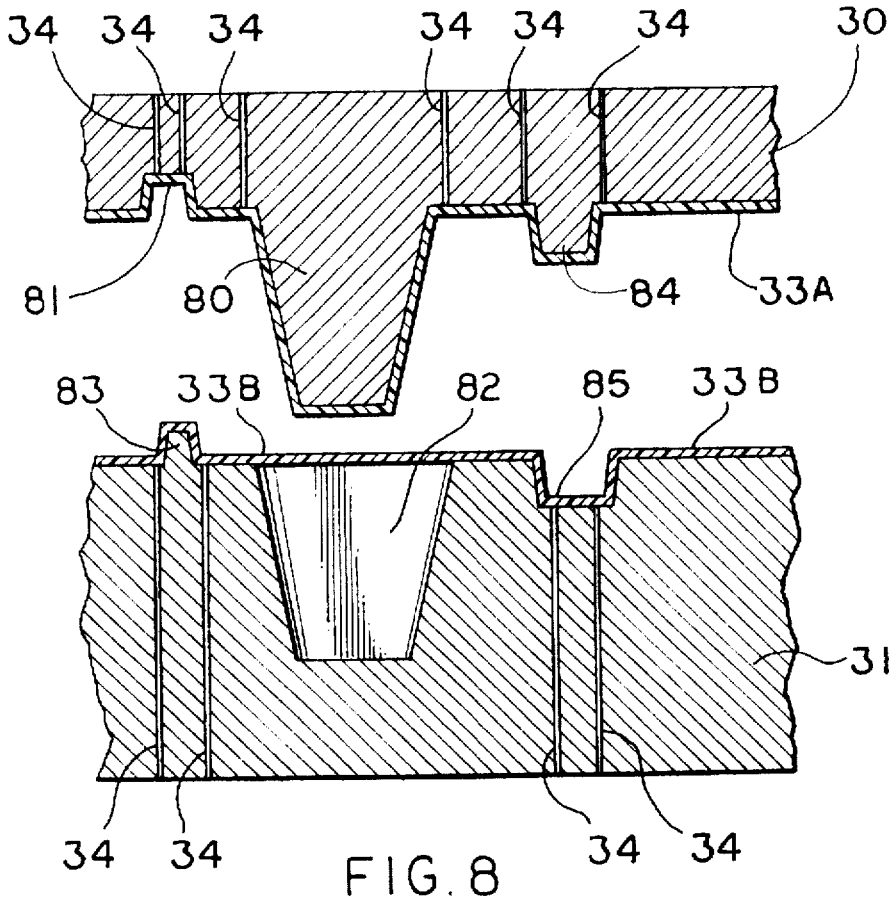
FIG. 8 is a fragmented sectional view of a portion of a mold useful in forming the pallet of FIG. 1, and showing two mold sections separated during the formation of the pallet.

With respect to the vacuum thermoforming procedure, as previously described and as shown in FIG. 8 male mold section 30 is provided with vacuum holes 34, and blank sheet 33*a* is formed thereto in a conventional manner. Male mold section 30 is provided with a profile for forming various portions of pallet 10. For example, protrusion 80 is employed for making a foot such as foot 20, 21 or 22, while cavity 81 may be employed for forming cones 60. Similarly, female mold section 31 is provided with foot cavity 82 corresponding to protrusion 80, and a protrusion 83 corresponding to cavity 81. Other profiles such as formed by protrusion 84 and cavity 85 may be provided as desired.

According to the invention, plastic blank sheet 33*b* is also thermoformed to female mold section 31 in a conventional manner, employing vacuum holes 34 thereof. However, the portion of sheet 33*b* proximate to each foot 20, 21 or 22 is not vacuum thermoformed. This may be accomplished by not providing vacuum holes 34 connected to foot cavity 82, as shown in the drawings. This may also be accomplished by providing apertures (not shown) connected to foot cavity 82, but through which no vacuum is pulled. Such "non-connected" apertures would be substantially identical in structure to vacuum apertures 34, except that they would be sealed off (not shown) or otherwise not connected to the vacuum during thermoforming. All such means may be referred to as "sealing" that portion of mold section 31. The resulting sheet 33*b*, as depicted in FIG. 8, is thermoformed to female mold section 31 as is conventional, except for the area proximate to foot cavity 82.

Figure 9:
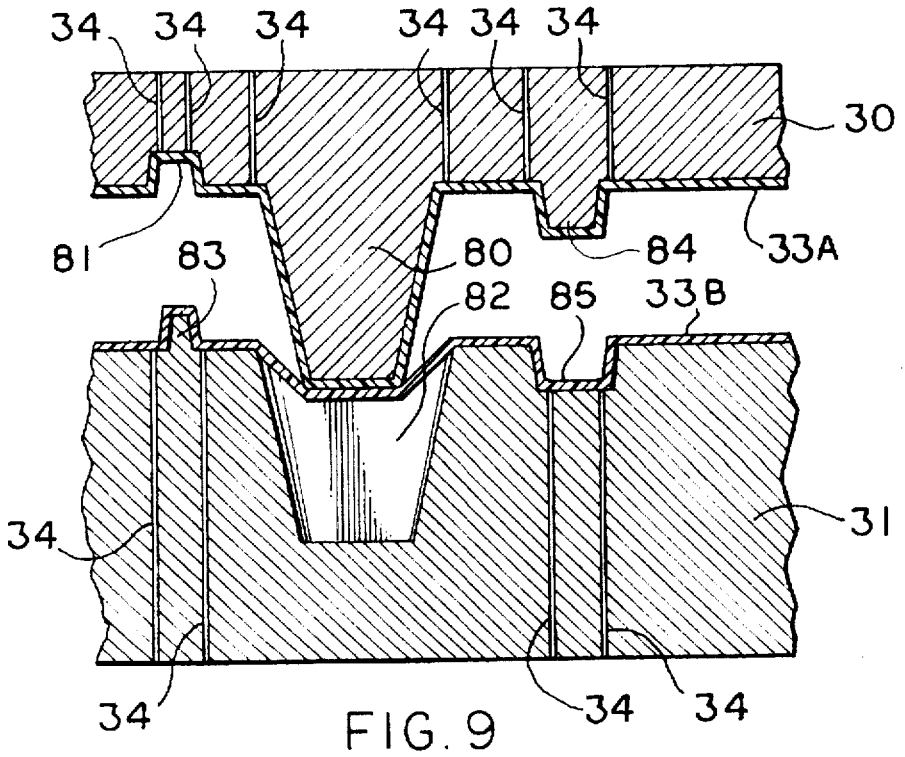
FIG. 9 is a view similar to FIG. 8, wherein the two mold sections have been moved closer together.
Figure 10:
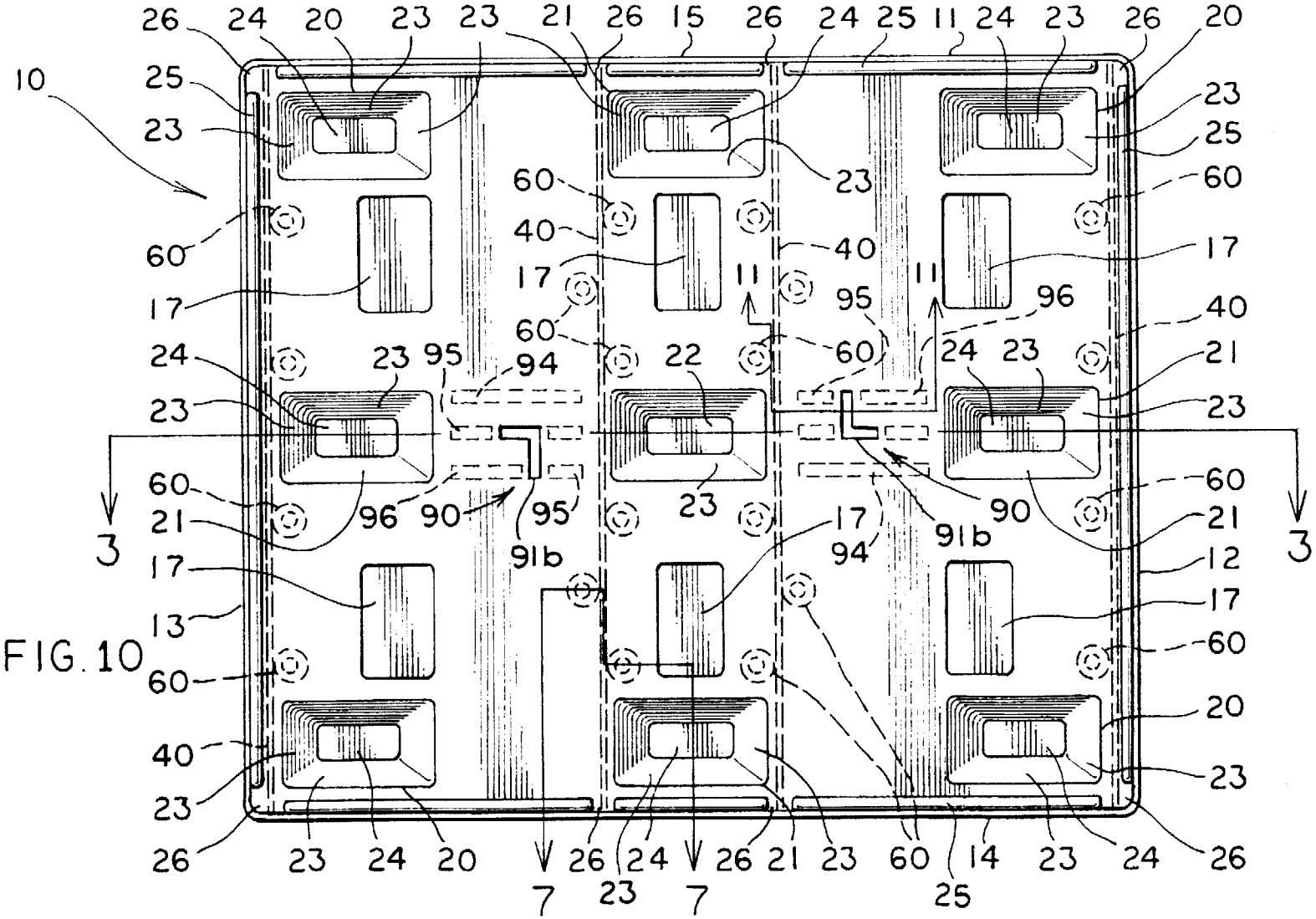
FIG. 10 is a top plan view of a pallet similar to that as in FIG. 2, but shown with reinforcing slots in the top surface thereof, and showing reinforcing protrusions in phantom lines.

Immediately after vacuum thermoforming, or after sufficient heating to the softening temperatures such as those discussed above, one or the other or both male mold section 30 and female mold section 31 are moved toward one another. As shown in FIG. 9, sheet 33*a* thermoformed to protrusion 80 of male mold section 30 physically contacts sheet 33*b* proximate to foot cavity 82, forcing that portion of sheet 33*b*, which is soft and pliable at the elevated temperatures, into foot cavity 82. It will be appreciated that the portion of sheet 33*b* proximate to foot cavity 82 will remain at a higher temperature than contiguous portions of sheet 33*b*, because heat from the contiguous portions will be drawn away by mold section 31. By bringing mold sections 30 and 31 together under pressure (not shown) the feet 20, 21 and 22 of pallet 10 are formed by compression molding. This results in strong downwardly extending solid feet 20, 21 and 22.

As stated hereinabove, it is often the case that materials stacked on a pallet such as pallet 10, will be provided with structures such as bands or straps (not shown) to secure the materials to the pallet. In this manner, the movement of the materials during shipping is minimized.

In order to further minimize movement of stacked materials during shipping, there is provided according to the invention a retaining wall assembly 90 which preferably operates in cooperation with edge protrusion 25. That is, retaining wall assembly 90 is preferably positioned within sides 12, 13 and 15, 16 and also within edge protrusions 25. It is further preferred that retaining wall assembly 90 be generally centrally located in upper surface 11 of pallet 10, as depicted in the drawings. While the drawings depict two centrally located retaining wall assemblies 90, any number of such assemblies is within the scope of the invention.

Preferably, retaining wall assembly 90 is positioned at a mid portion of pallet 10, such that the material placed upon pallet 10 is held in position by cooperation between retaining wall assembly 90 and edge protrusion 25. As will be appreciated, movement of material stacked on pallet 10 will be minimized by contact with retaining wall assembly 90 and edge protrusion 25.

Figure 11:
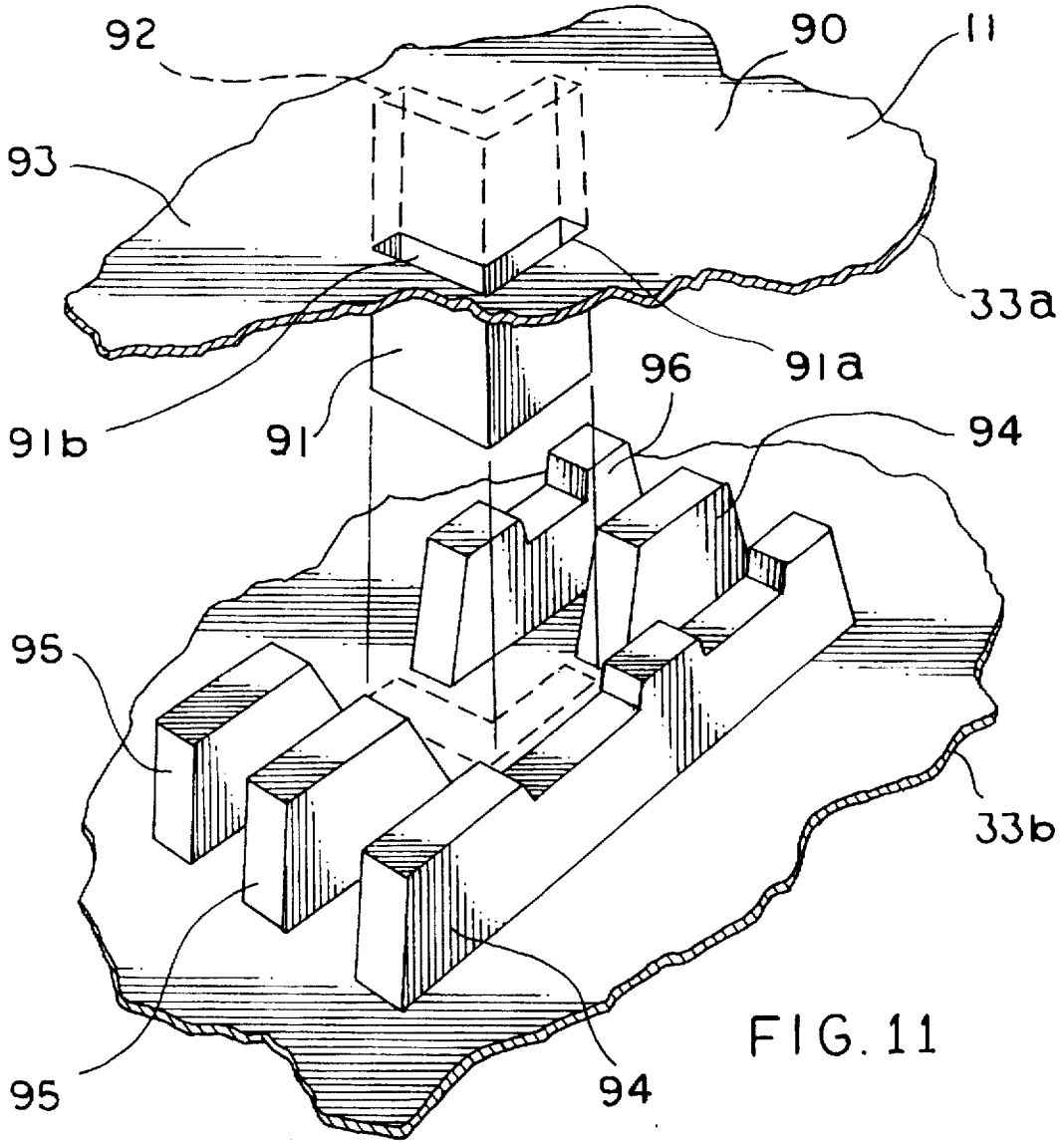
FIG. 11 is an exploded, fragmentary, perspective view of one portion of the pallet of FIG. 10.

It is preferred that retaining wall assembly 90 include a retaining wall-receiving slot 91, into which there may be inserted a retaining wall 92. Wall-receiving slot 91 is thermoformed as a downwardly extending portion of load bearing surface 11, formed in a manner similar to that described hereinabove with for example, feet 20. FIG. 11 shows the twin sheets 33*a* and 33*b* in an exploded view, such that the downwardly extending wall-receiving slot 91 is visible. An open area 93 (FIG. 11) into wall-receiving slot 91 is positioned in load bearing surface 11.

Retaining wall 92 may be formed from wood, metal, plastic or other suitable material, but is preferably corrugated cardboard for that material's well known desired strength versus weight ratio. A section of retaining wall 92 is positioned in retaining wall-receiving slot 91 by inserting it through open area 93, as shown by phantom lines in FIG. 11. Material placed upon pallet 10 will thus be held in place by contact with retaining wall 92 in a manner as described hereinabove. Retaining wall 92 need be at no particular shape or size, except that it be receivable within slot 91 as discussed hereinabove.

While wall-receiving slot 91 need no necessarily be of any particular configuration, it is preferred that it be "L-shaped" as depicted in the drawings. In this configuration, two retaining walls 92 may be positioned at an angle to each other, thus securing the material in two directions. Also, if the L-shaped slot 91 is employed with material placed in boxes and then stacked on the pallet 10, the L shape will cooperate with box corners in an efficient manner. It will be appreciated also that one retaining wall 92 may be employed with the L-shaped slot 91. In that case, the flexibility of cardboard allows one wall 92 to be flooded into an L shape.

Figure 12:
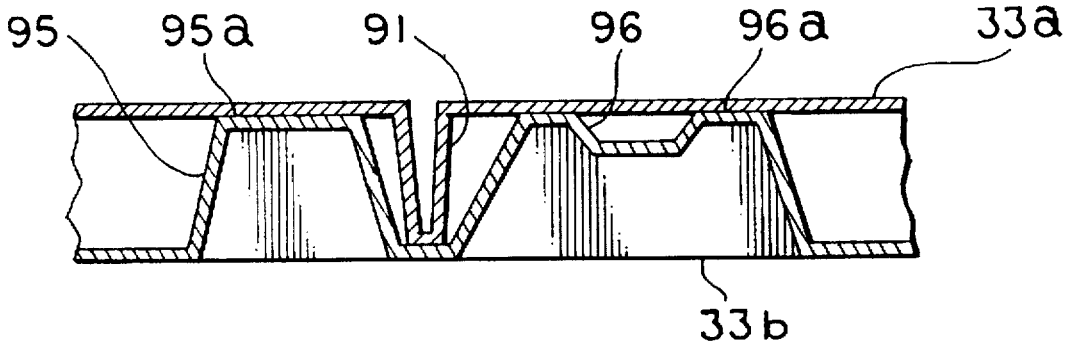
FIG. 12 is a fragmentary, side elevational, sectional view taken along line 11—11 of FIG. 10.

It is also preferred that slot 91 be narrow enough such that wall 92 is held in place by friction within slot 91, although other means of affixing wall 92 within slot 91 are within the scope of the invention, such as by being affixed with adhesives, bolts or the like. It is preferred to use the friction fit or other means for allowing wall 92 to be easily removed from slot 91. As shown in FIG. 12, one means of providing for a friction fit is to taper slot 91 inwardly and downwardly from open area 93.

Similarly, it desired to form slot 91 with a depth sufficient to allow wall 92 to be secured therein. The actual dimensions of slot 91, as will be appreciated, will vary depending upon the nature of wall 92, pallet 10 and the material to be stacked thereon. Wall 92 should be able to be positioned within slot 91 and removed therefrom by hand, and yet secured within slot 91 sufficiently to prevent its unintentional removal caused by forces exerted during pallet transportation and use.

Pallet 10 may also be provided with a reinforcing protrusion 94 formed preferably, as upwardly extending portions of second sheet 33*b* and extending between first and second sheets 33*a* and 33*b*. As best shown in FIG. 11, reinforcing protrusion 94 need be of no particular shape, and may for example be shaped as protrusions 95, 96 or any other shape as will be appreciated by one skilled in the art. Protrusions 94, 95 and 96 preferably extend upwardly from second sheet 33*b* and engage first sheet 33*a* at for example, location 95*a* and 96*a* (FIG. 12), and may actually be fused or otherwise affixed thereto. Because an open area may be formed between first sheet 33*a* and second sheet 33*b* during formation of slot 91, reinforcing protrusions 94, 95 and 96 may be used to support and provide strength between sheets 33*a* and 33*b* at that location. It will be appreciated of course, that reinforcing protrusions 94, 95 and 96 may extend downwardly from first sheet 33*a*. The reinforcing action thereof is provided by the extension between sheets 33*a* and 33*b* and is not necessarily dependent upon the sheet from which they extend. In fact, reinforcing protrusions 94, 95 and 96 my be separate members not formed in either sheet 33*a* or 33*b*.

An alternative, preferred embodiment of the present invention is generally depicted in the drawings by the number 100. As with pallet 10, pallet 100 is the type useful for bearing a load, and may be provided with a generally planar, upper, load bearing surface 101. Pallet 100 is generally rectilinear, that is, pallet 100 is provided with spaced, opposing sides 102 and 103, as well as spaced opposing sides 104 and 105. Sides 102 and 103 are generally perpendicular to sides 104 and 105, and planar load bearing surface 101 generally extends between and connects sides 102, 103, 104 and 105, as does its lower surface 106. If desired, pallet 100 may be provided with apertures 107 for purposes of ventilation, weight saving, strength, or the like.

Extending between and separating upper surface 101 and lower surface 106 are support columns or struts 120.

Figure 13:
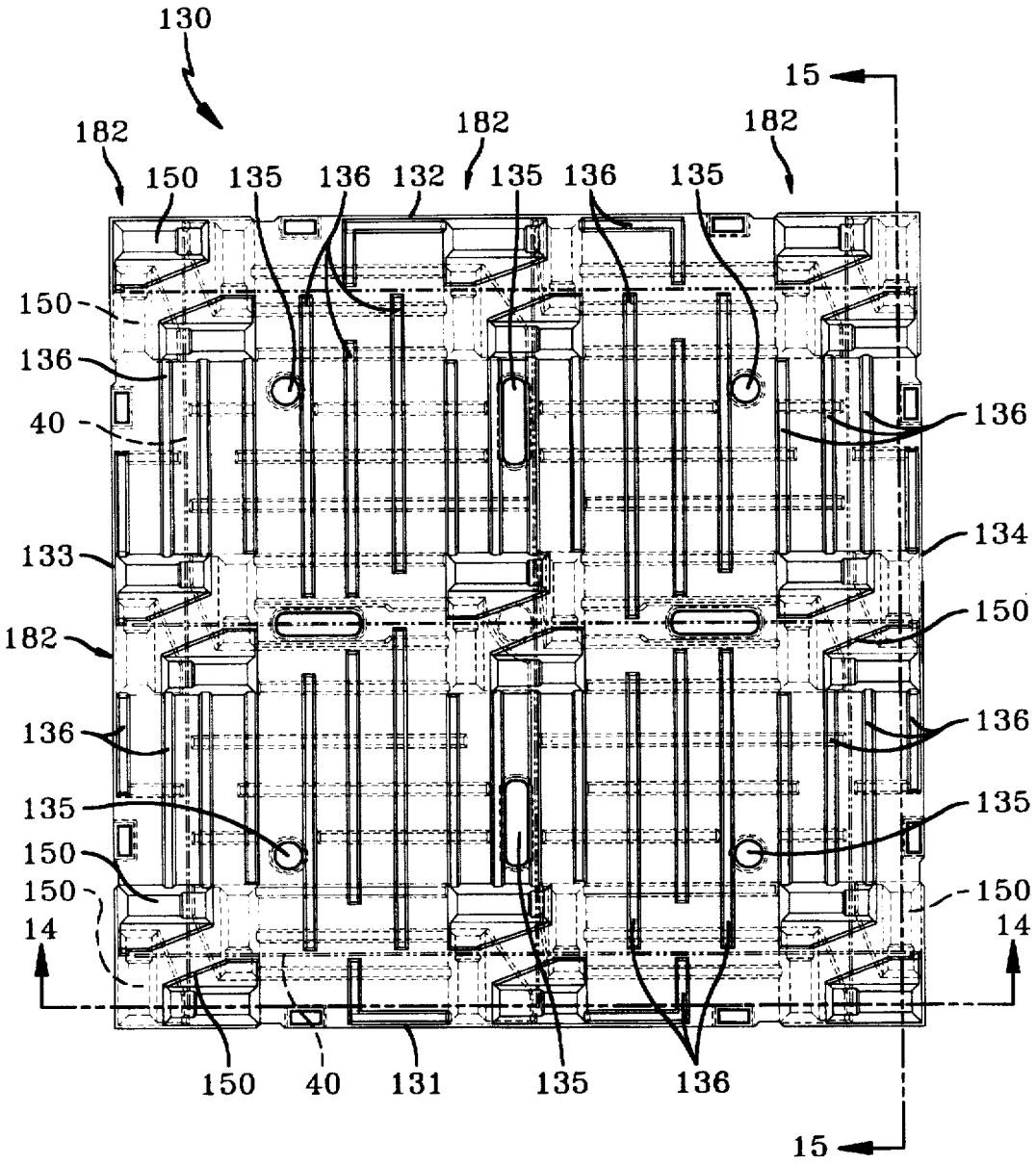
FIG. 13 is an alternative embodiment of a pallet according to the present invention.
Figure 14:
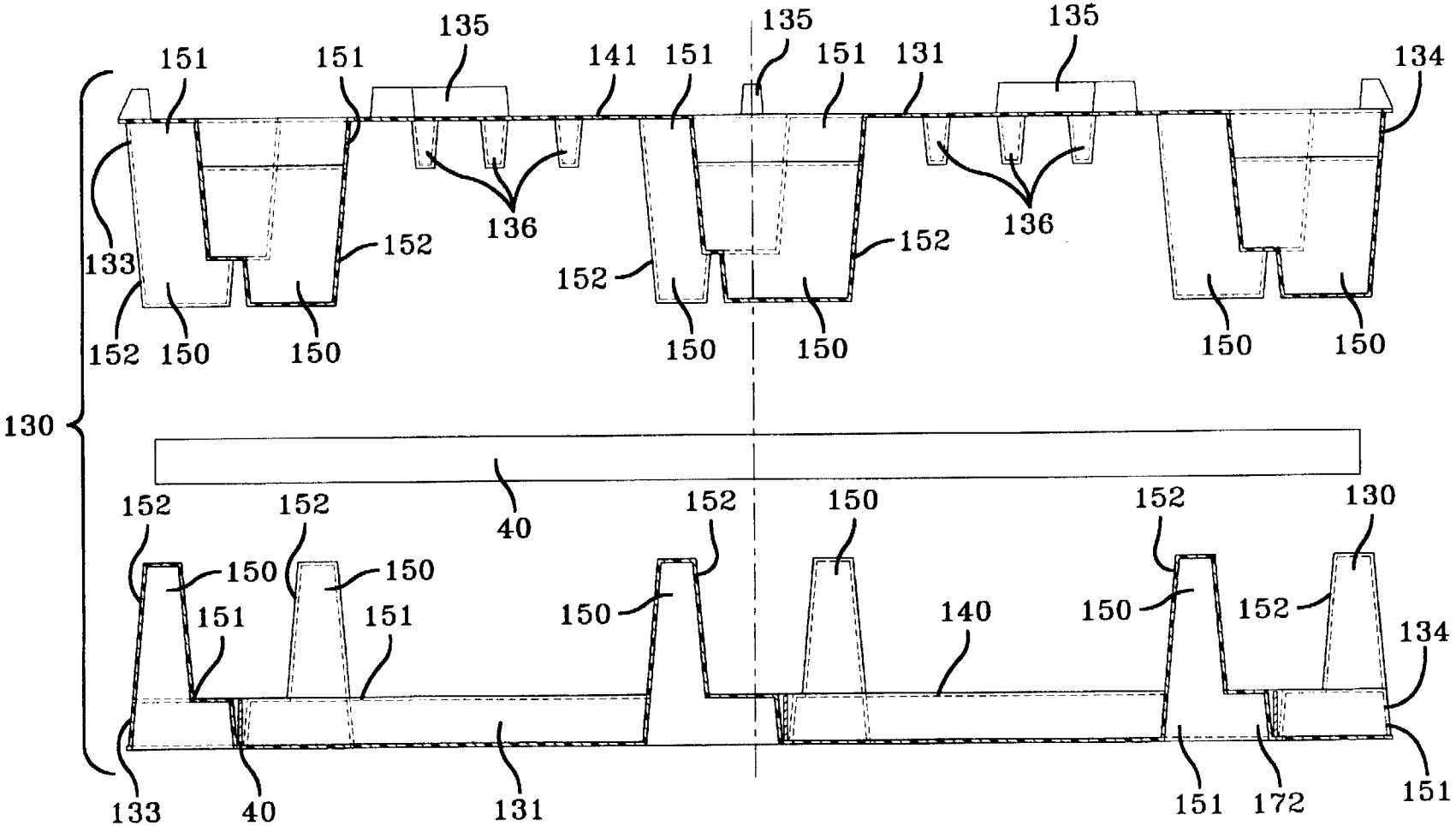
FIG. 14 is an exploded view of the pallet to FIG. 13 taken along lines 14—14 thereof.
Figure 15:
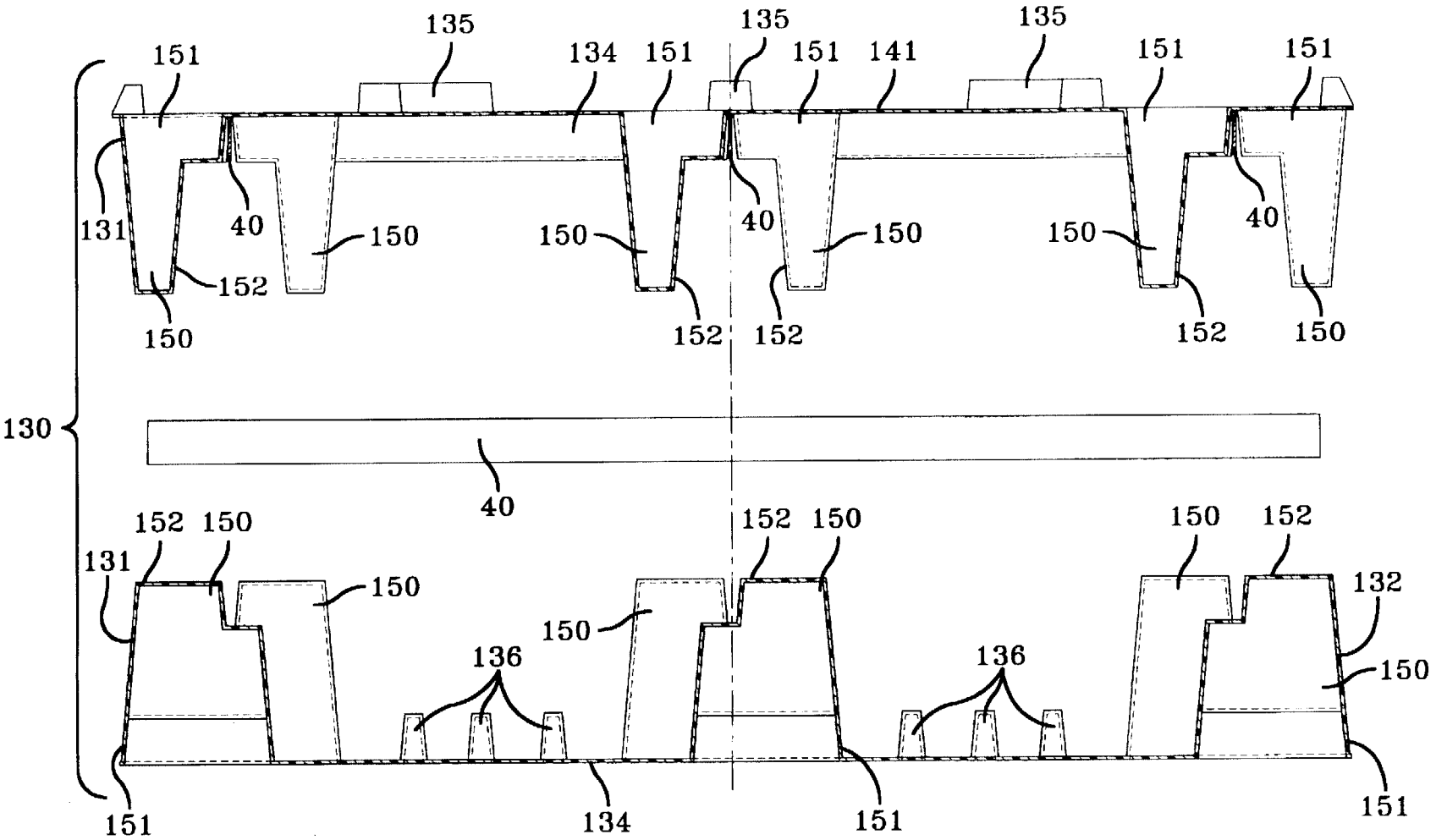
FIG. 15 is an exploded view taken along line 15—15 of FIG. 13.

Another embodiment of an on-edge steel reinforced pallet according to the present invention is generally designated by the number 130 in FIGS. 13–15. As with pallet 10, pallet 130 is generally rectilinear, having spaced, opposing sides 131 and 132, as well as spaced opposing sides 133 and 134. Sides 131 and 132 are generally perpendicular to sides 133 and 134. If desired, pallet 130 may be provided with protrusions 135 for purposes of strength, locators for materials loaded on pallet 130 or the like, as well as any number of strengthening ribs 136 and the like.

Pallet 130 is formed by a first sheet 140 and a second sheet 141, arranged in an opposing manner similar to that discussed above with respect to sheets 33*a* and 33*b*. Sheets 140 and 141 are preferably thermoformed in a manner also as described hereinabove. Further, sheets 140 and 141 may be identical in structure to each other, although this is not required for practice of the present invention.

Pallet 130 provides for on-edge, thin steel support in two directions, one steel reinforcement being generally parallel to opposing sides 131 and 132, and another being generally parallel to opposing sides 133 and 134, in a manner to now be more fully described. The steel reinforcements used for this embodiment are preferably identical to reinforcement bars 40 as described hereinabove.

In order to secure a reinforcement bar 40 in a reinforcing position generally parallel to sides 131–132 or 133–134, each sheet 140 and 141 is provided with a plurality of complementary, extending web members 150. Each web member 150 of sheet 140 interacts with a web member 150 extending from sheet 141 in order to secure a reinforcement bar 40 therebetween. Web members 150 are preferably thermoformed during formation of a sheet 140 or 141, such that it is integrally formed with such sheets.

Figure 16:
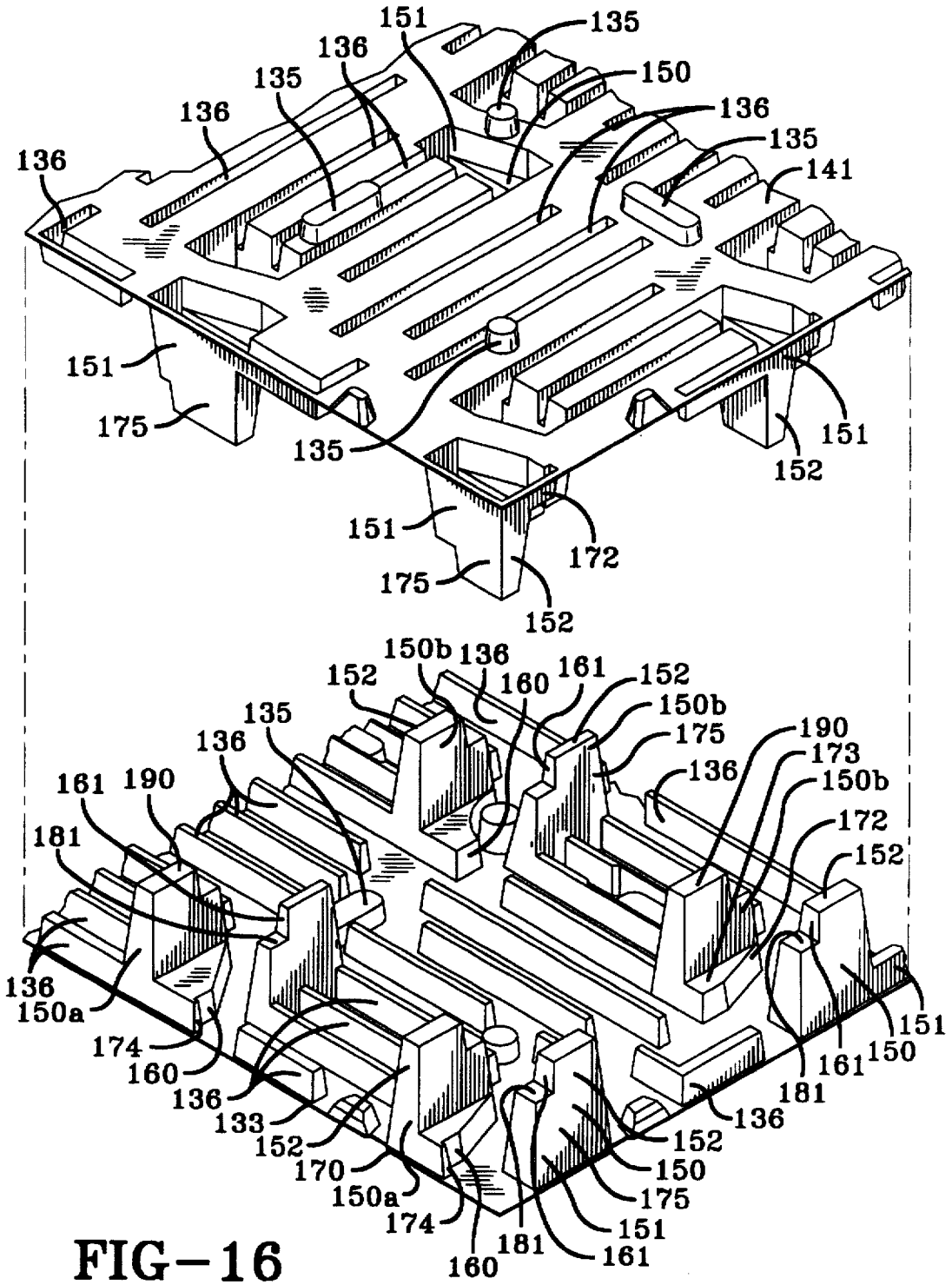
FIG. 16 is an exploded close-up view of one portion of the pallet of FIG. 13.
Figure 18:
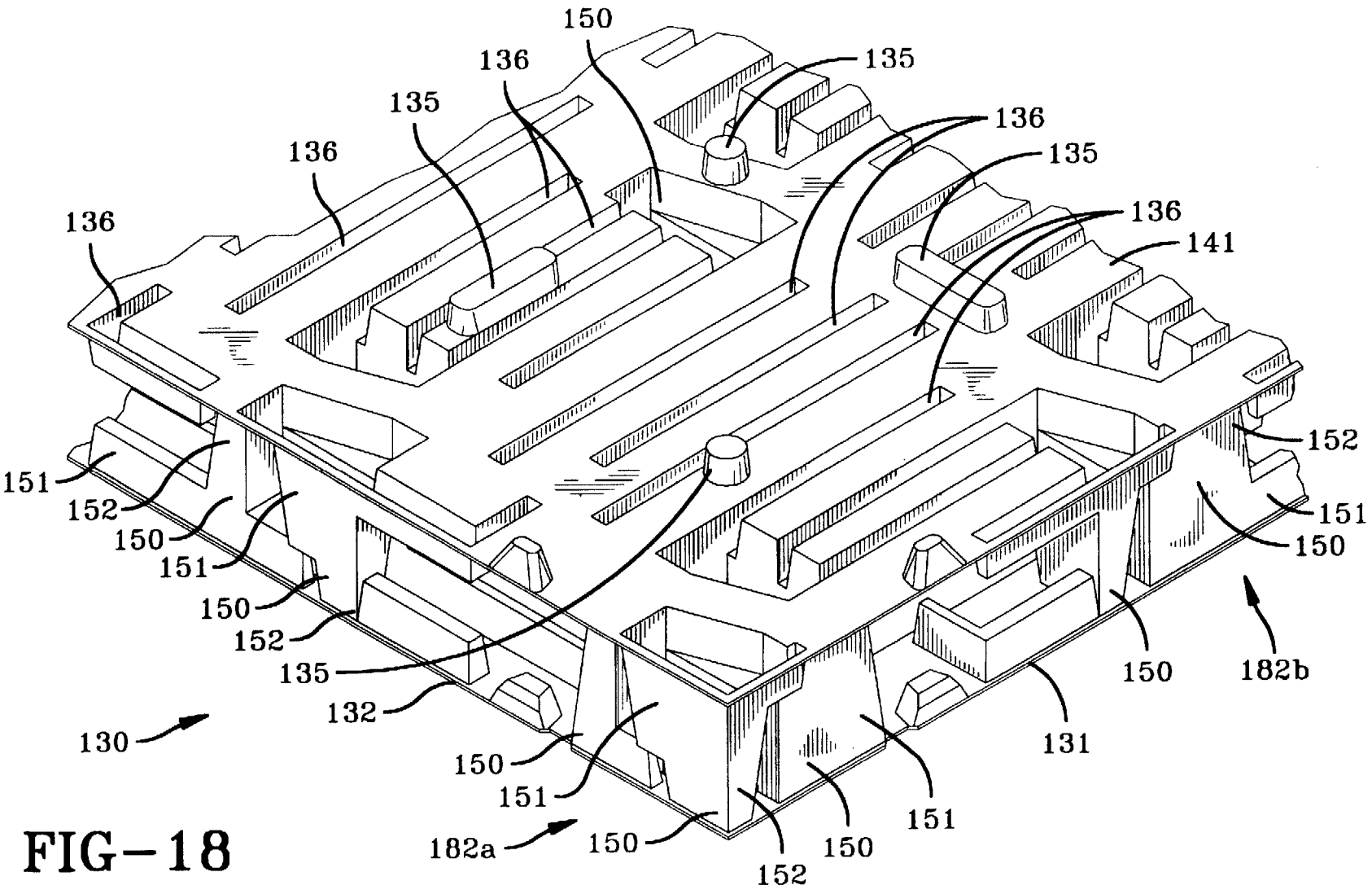
FIG. 18 is a close-up, perspective view of one portion of the pallet of FIG. 13.

Each web member 150 is provided with an end 151 proximate to the sheet 140 or 141 from which it extends, and an end 152 distal thereto. Proximate ends 151 of webs 150 provide a profile wall surface 160 (FIG. 16). Similarly, distal ends 152 of webs 150 are provided with second profiled wall surfaces 161. Each web 150 interactively cooperates with another web 150 extending from the opposite sheet 140 or 141, such that the profile wall 160 of the proximate end of a first web 150 is complementary to the second profile wall 161 of a second web 150, when sheets 140 and 141 are brought together as shown in FIG. 18, to form a socket 162 therebetween. By "socket" 162 it is meant an area between two cooperating webs 150 extending from opposite sheets 140 or 141, and more particularly between a first profiled wall 160 of one web 150 and a second profiled wall 161 of the opposite web 150, in which area is placed a reinforcing bar 40. Socket 162 is formed and substantially encapsulates at least a portion of the longitudinal length of a given reinforcing bar 40.

Thus, each web 150 can support two reinforcement bars 40 in a spaced, angled relation to each other, one bar 40 at the proximate end 151 and another at the distal end 152 of web 150. While a preferred angle of the relation between spaced reinforcing bars 40 is about 90 degrees, the angle is not necessarily critical to the invention, although certain angles may be useful to the actual performance of the end product.

A preferred web 150 will now be described with reference to FIG. 16. Web 150 extending from sheet 140 has a base portion 170 at the point of intersection with sheet 140. Base portion 170 provides and supports first profiled wall portion 160, positioned so as to adequately form socket 162. Base portion 170 may include any number of surfaces 172 and 173 for strength, positioning or the like as required. It is preferred that first profiled wall 160 extends from sheet 140 in a manner substantially perpendicular thereto. If web 150 is on the edge 133 of sheet 132, as depicted in FIG. 16 with respect to web 150*a*, then first wall profile 161 may be provided with a shoulder member 174 to prevent a reinforcement bar 40 from "slipping" out of socket 162. A web 150 on the interior of pallet 130, such as web 150*b*, would not be provided with shoulder member 174.

Web 150 also is provided with transversely extending wall portion 175, the length of which is not critical to practice of the invention, but which should be at least long enough to allow adequate separation between angled reinforcing bars 40 positioned by the given web 150.

Web 150 terminates at distal end 152 with second wall profile 161. Preferably, wall profile 161 is positioned at a right angle to a landing surface 181, such that a shoulder 182 is formed therebetween. Preferably, the plane of first wall profile 160 is angled with respect to the plane of second wall profile 161 to the same degree as the desired angle between two angled reinforcing bars 40.

Figure 17:
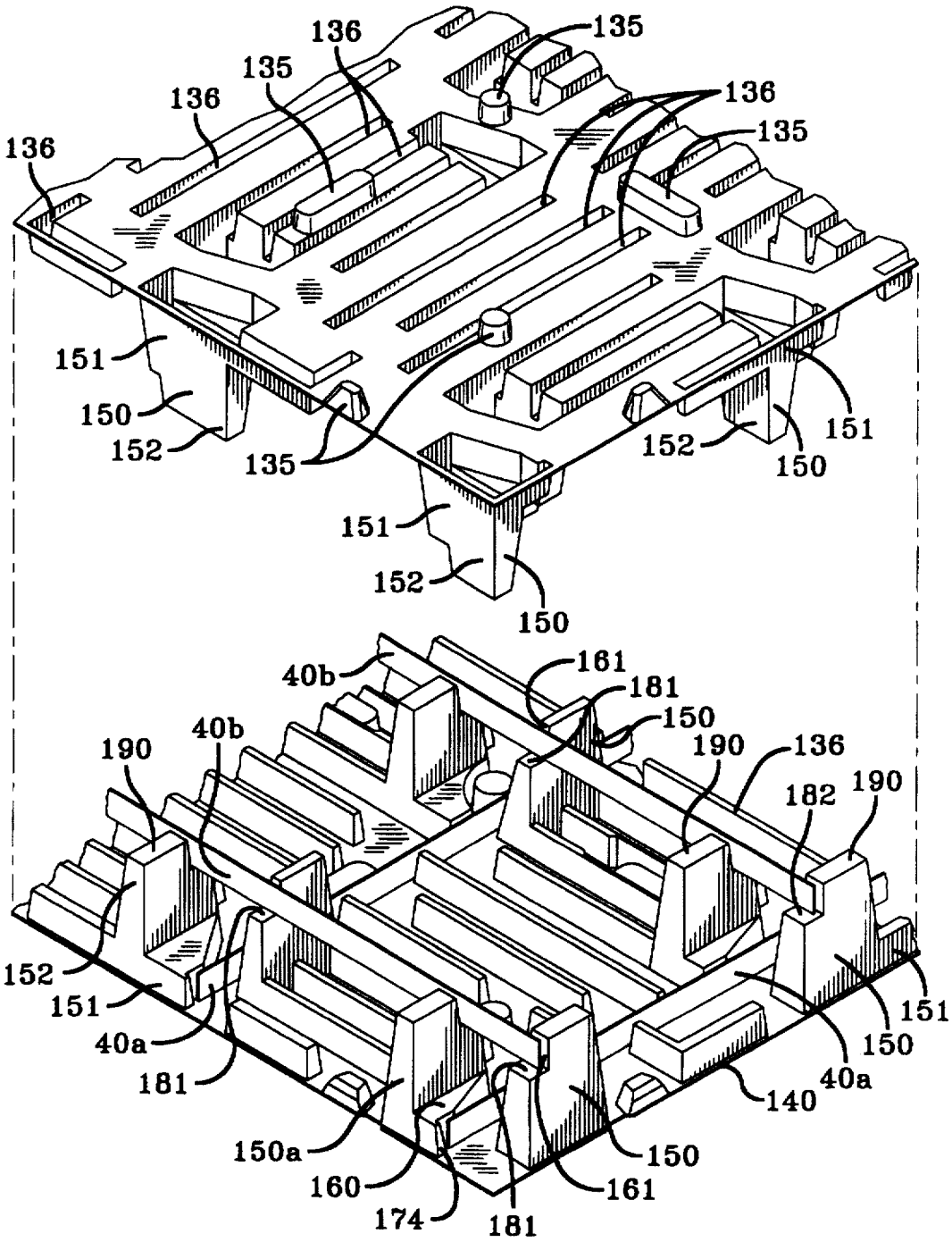
FIG. 17 is the same view as in FIG. 16 shown with reinforcing bars in place therein.

As shown in FIG. 17, a first reinforcing bar 40*a* is positioned by physical contact with sheet 140 and with first wall profile 160. Similarly, a second reinforcing bar 40*b* is positioned by physical contact with second wall profile 161 and landing surface 181, at a substantially right angle to reinforcing bar 40*a*. Because of the distance between first and second wall profiles 160 and 161, reinforcing bars 40*a* and 40*b* are also spaced from each other. This allows each reinforcing bar 40*a* and 40*b* to extend the full length of the pallet if desired.

It is also preferred to provide a set of four interacting webs 150, with two opposing and spaced parallel arranged webs 150 extending from each sheet 140 and 141. The proximate end of each web 150 thereby interacts with the distal end of a first web 150 from the opposing sheet 140 or 141, while its distal end interacts with the proximate end of a second, separate web 150 also extending from the opposite sheet 140 or 141. Thus, four webs 150 interact as one-fourth of a quadrant generally designated by the number 182. The quad arrangement, while preferred, is not necessarily critical, and other numbers of webs 150 interacting as described are within the scope of the invention.

Distal ends 151 of each web 150 may be provided with terminal surfaces 190, which are preferably substantially flat and which physically contact the sheet 140 or 141 opposite that sheet from which the given web 150 extends. At the point of physical contact, it is preferred to thermally fuse or otherwise bond web 150 to the opposing sheet 140 or 141. This will at least in part, secure sheets 140 and 141 together.

As depicted in the drawings, pallet 130 may include a plurality of web members 150 extending from sheets 140 and 141 as described hereinabove, such that a plurality of spaced and angled reinforcing bars 40 may be used to strengthen pallet 130. Further, the open areas between two quadrants 182 proximate to an edge 131, 132, 133 and/or 134, such as quadrants 182*a* and 182*b* in FIG. 18, provide a forklift access area for pallet 130.

Based upon the foregoing disclosure, it is apparent that the use of the pallets described herein will carry out the objects set forth hereinabove. It is, therefore, to be understood that any variations evident fall within the scope of the claimed invention and thus, the selection of specific component elements can be determined without departing from the spirit of the invention herein disclosed and described. In particular, the materials of construction, the actual configuration and the number of component elements of the pallet according to the present invention are not necessarily limited to those specifically discussed. Thus, the scope of the invention shall include all modifications and variations that may fall within the scope of the attached claims.

What is claimed is:

1. A twin-sheet plastic pallet for bearing a load, comprising a generally rectilinear, thermoformed body comprising a first sheet and a second sheet positioned in an opposing relation; each of said first and second sheets having an outer surface and at least one support web extending therefrom, each of said support webs having an end proximate to said outer surface from which it extends and an end distal thereto; said distal end of said web extending from said first sheet having a profile wall portion that forms a first socket portion; said proximate end of said web extending from said second sheet having a profile wall portion that forms a second socket portion; said first and second socket portions cooperating to form a first socket; a reinforcing bar means positioned within said first socket; said proximate end of said web extending from said first sheet having a wall portion that forms another, separate first socket portion; said distal end of said web extending from said second sheet having a wall portion that forms another, separate second socket portion; said another, separate first socket portion and said another, separate second socket portion cooperating to form a second socket; a second reinforcing bar means positioned within said second socket; wherein said first and second sockets are positioned at an angle with respect to each other, such that said first and second reinforcing bar means are also angled with respect to each other.

2. A pallet, as set forth in claim 1, wherein said first and second sheets each have an outer surface and at least one support web extending transversely therefrom, each said support web having an end proximate to said outer surface from which it extends and an end distal thereto.

3. A pallet, as set forth in claim 1, wherein said angle is approximately 90 degrees.

4. A pallet, as set forth in claim 1, comprising a plurality of said webs such that a each of said first and second reinforcing bars is substantially supported thereby.

5. A pallet, as set forth in claim 1, such that said first reinforcing bar is of a thin construction and is placed on-edge within said first socket.

6. A pallet, as set forth in claim 1, further comprising a plurality of strengthening protrusions in each of said first and second sheets.

7. A method of forming a reinforced plastic pallet comprising the steps of thermoforming a first and a second plastic blank into the shape of the desired pallet; wherein said step of thermoforming includes forming a first support web in each of said first and second sheets, each of said first support webs having a first complementary socket portion and a second complimentary socket portion angularly disposed with respect to said first complimentary socket portion; affixing said first and second sheets together in an opposing relation such that said first complementary socket portions together form a first socket and said second complementary socket portions together form a second socket; and, positioning a reinforcing bar within each of said first and second sockets; said first and second reinforcing bars being vertically spaced with respect to each other, and said first and second reinforcing bars are also angled with respect to each other.

8. A twin sheet plastic pallet for bearing a load, comprising a generally rectilinear, thermoformed body comprising first and second opposed sheets; at least two reinforcing bars carried by said sheets each of said reinforcing bars extending substantially the entire width of one of said sheets; said reinforcing bars being overlapped and vertically spaced from one another reinforced without the bars contacting each other.

9. A pallet as set forth in claim 8 wherein each of said reinforcing bars is disposed in a substantially horizontal plane.

10. A pallet as set forth in claim 8 wherein said reinforcing bars are angularly disposed with respect to each other.

11. A pallet as set forth in claim 10 wherein said reinforcing bars are disposed at a substantially right angle.

12. A pallet as set forth in claim 8 wherein each of said reinforcing bars extend substantially the entire length of each sheet.

* * * * *

UNITED STATES PATENT AND TRADEMARK OFFICE

CERTIFICATE OF CORRECTION

PATENT NO. : 5,755,162

DATED : May 26, 1998

INVENTOR(S) : Knight et al.

It is certified that error appears in the above-identified patent and that said Letters Patent is hereby corrected as shown below:

Column 12, line 20, after the word "sheets" insert --;--.

Column 12, line 23, after the word "another" insert --such that the pallet is--.

Signed and Sealed this

Twenty-third Day of February, 1999

*Attest:*

Q. TODD DICKINSON

*Attesting Officer*

*Acting Commissioner of Patents and Trademarks*